US005223589A

United States Patent [19]

Kulprathipanja et al.

[11] Patent Number: 5,223,589

[45] Date of Patent: Jun. 29, 1993

[54] PROCESS FOR SEPARATING DURENE FROM SUBSTITUTED BENZENE HYDROCARBONS

[75] Inventors: Santi Kulprathipanja, Inverness; Kenneth K. Kuhnle, St. Charles; Marjorie S. Patton, Darien, all of Ill.

[73] Assignee: UOP, Des Plaines, Ill.

[21] Appl. No.: 872,191

[22] Filed: Apr. 22, 1992

[51] Int. Cl.[5] ..... C07C 7/12; C07C 7/00

[52] U.S. Cl. ..... 585/828; 585/825; 585/831; 585/853

[58] Field of Search ..... 585/825, 828, 831, 853

[56] References Cited

U.S. PATENT DOCUMENTS

| | | | |
|---|---|---|---|
| 2,985,589 | 5/1961 | Broughton et al. | 210/34 |
| 3,040,777 | 6/1962 | Carson et al. | 137/625.15 |
| 3,422,848 | 1/1969 | Liebman et al. | 137/625.15 |
| 3,706,812 | 12/1972 | De Rosset et al. | 260/674 SA |
| 3,864,416 | 2/1975 | Campbell et al. | 260/674 A |
| 4,642,397 | 2/1987 | Zinnen et al. | 568/934 |
| 4,743,708 | 5/1988 | Rosenfeld et al. | 585/828 |

OTHER PUBLICATIONS

Chartov et al. Chem. Abstract 92(7) 58328d (1972)—Abstract only, page unavailable.

*Primary Examiner*—Helen M. S. Sneed
*Assistant Examiner*—Nhat D. Phan
*Attorney, Agent, or Firm*—Thomas K. McBride; John F. Spears, Jr.; Jack H. Hall

[57] ABSTRACT

The separation of durene in high purity from coal tar or petroleum fractions by an adsorptive chromatographic process and liquid phase with lithium-exchanged X zeolite as the adsorbent and liquid aromatic desorbents.

4 Claims, No Drawings

PROCESS FOR SEPARATING DURENE FROM SUBSTITUTED BENZENE HYDROCARBONS

FIELD OF THE INVENTION

The field of art to which this invention belongs is the solid bed adsorptive separation of durene. More specifically, the invention relates to a process for separating durene from a coal tar distillate or an alkylate stream containing substituted benzene hydrocarbons boiling in the same range.

BACKGROUND OF THE INVENTION

Durene in purified form is in substantial demand as an intermediate for a variety of uses, for example, synthetic polymers, e.g., coatings for semiconductors, fibers, plastomizers, organic synthesis, etc. Readily available sources of durene are coal tar distillates or fractions resulting from catalytic processing of petroleum and alkylation of o-xylene. Normally, purification is accomplished by re-crystallization of a fraction having a narrow boiling point range and/or melting point, but a large number of theoretical stages is required. According to Chartov et al, durene could not be separated from its isomers by adsorption on zeolites (Chem. Abstract 92 (7):58328d (1972)), since the difference in critical diameters between the isomers is too small.

Campbell et al, U.S. Pat. No. 3,864,416, disclosed that 2,4,5-trimethylcumene can be separated from mixtures of tetra-alkyl-substituted benzenes with X or Y zeolites exchanged with Group I-A metals, particularly sodium, potassium and cesium. However, the 2,4,5-trimethylcumene is rejected while the other isomers are selectively adsorbed. In the present invention, 1,2,4,5-tetramethylbenzene (durene) is unexpectedly selectively adsorbed by lithium-exchanged X zeolite, whereas zeolites exchanged with ions other than lithium reject durene as might be expected from the teachings of Campbell et al.

U.S. Pat. No. 4,743,708 discloses a process for separating a $C_{10}$ aromatic isomer, particularly paradiethylbenzene from a feed stream of $C_{10}$ aromatic isomers by contacting the stream with the adsorbent, zeolite beta. It is also stated that durene is preferentially adsorbed over prehnitene and isodurene. However, the patentees do not teach applicants' separation with a lithium-exchanged zeolite. Patentee preferred sodium as the ion exchange cation. However, sodium-exchanged X zeolite, was unsatisfactory in applicants' separation, for the reason that durene and isodurene were coextracted and, hence, no separation was obtained. It is more advantageous to be able to separate durene by extraction on an X zeolite than on a zeolite beta because X zeolite is commercially available.

The functions and properties of adsorbents and desorbents in the chromatographic separation of liquid components are well known, but for reference thereto, Zinnen et al U.S. Pat. No. 4,642,397 is incorporated by reference herein.

The invention herein can be practiced in fixed or moving adsorbent bed systems, but the preferred system for this separation is a countercurrent simulated moving bed system, such as described in Broughton U.S. Pat. No. 2,985,589, incorporated herein by reference. Cyclic advancement of the input and output streams can be accomplished by a manifolding system, which are also known, e.g., by rotary disc valves shown in U.S. Pat. Nos. 3,040,777 and 3,422,848. Equipment utilizing these principles are familiar, in sizes ranging from pilot plant scale (deRosset U.S. Pat. No. 3,706,812) to commercial scale in flow rates from a few cc per hour to many thousands of gallons per hour.

We have found a specific adsorbent lithium-exchanged X zeolite, which, in combination with certain aromatic desorbent liquids, will selectively adsorb durene from its isomers.

SUMMARY OF THE INVENTION

The present invention is a process for separating durene from a heavy gasoline fraction hydrocarbon mixture comprising durene, isodurene, prehnitene and other polyalkylated monocyclic aromatic hydrocarbons boiling in the range from 150° to 225° C., the steps comprising contacting the hydrocarbon mixture, under adsorption conditions, with an X zeolite adsorbent exchanged with lithium atoms at the exchangeable sites. Durene is selectively adsorbed to the substantial exclusion of the other components. The other components, 1,2,3,5-tetramethylbenzene (isodurene), 1,2,3,4-tetramethylbenzene (prehnitene) and other polyalkylated monocyclic hydrocarbons, are relatively non-adsorbed and are removed from contact with the adsorbent and durene is desorbed with a liquid aromatic desorbent having a boiling point of at least 5° higher or lower than the boiling point range of said hydrocarbon mixture, for example, 1,2,3-trimethylbenzene (hemimellitene, sometimes 1,2,3-TMB herein) 1,3,5-trimethylbenzene (mesitylene), toluene, p-xylene, chlorobenzene, benzene and m-xylene. The preferred desorbent is 1,2,3-TMB.

Other embodiments of our invention encompass details about feed mixtures, adsorbents, desorbent materials and operating conditions, all of which are hereinafter disclosed.

DETAILED DESCRIPTION OF THE INVENTION

Adsorbents to be used in the process of this invention comprise specific crystalline aluminosilicates or molecular sieves, namely X zeolites, exchanged at exchangeable cationic sites with lithium ions. The zeolites have known cage structures in which the alumina and silica tetrahedra are intimately connected in an open three-dimensional network to form cage-like structures with window-like pores. The tetrahedra are cross-linked by the sharing of oxygen atoms with spaces between the tetrahedra occupied by water molecules prior to partial or total dehydration of this zeolite. The dehydration of the zeolite results in crystals interlaced with cells having molecular dimensions and thus, the crystalline aluminosilicates are often referred to as "molecular sieves" when the separation which they effect is dependent essentially upon differences between the sizes of the feed molecules as, for instance, when smaller normal paraffin molecules are separated from larger isoparaffin molecules by using a particular molecular sieve. In the process of this invention, however, the term "molecular sieves", although widely used, is not strictly suitable since the separation of naphthalenes from other aromatic hydrocarbons having similar boiling points is apparently dependent on differences in electrochemical attraction of the different isomers and the adsorbent rather than on pure physical size differences in the isomer molecules.

In hydrated or partially form the preferred type X crystalline aluminosilicates encompass those zeolites represented, in terms of moles of metal oxides, by the formula 1 below:

Formula 1

$$(0.9\pm0.2)M_{2/n}O:Al_2O_3:(2.5\pm0.5)SiO_2:yH_2O$$

where "M" is a cation which balances the electrovalence of the tetrahedra and is generally referred to as an exchangeable cationic site, "n" represents the valence of the cation and "y" is a value up to about 9 and represents the degree of hydration of the crystalline structure.

Adsorbents comprising the type X zeolites are useful for the adsorptive process for extracting durene from hydrocarbon mixtures herein described. These zeolites are described and defined in U.S. Pat. No. 2,882,244. The term "type X structured" zeolites as used herein shall include all zeolites which have general structures as represented in the above cited patent.

Typically, the type X structured zeolites, as initially prepared, are predominantly in the sodium form. The term "exchanged cationic site" generally refers to the site in the zeolite occupied by the cation "M". This cation, usually sodium, can be replaced or exchanged with other specific cations, dependent on the type of the zeolite to modify characteristics of the zeolite. The zeolites useful in this invention are type X zeolites exchanged with lithium ions.

Cations occupying exchangeable cationic sites in the zeolite are exchanged with other cations by ion exchange methods well known to those having ordinary skill in the field of crystalline aluminosilicates. Such methods are generally performed by contacting the zeolite or an adsorbent material containing the zeolite with an aqueous solution of the soluble salt, e.g., the chloride of the cation or cations desired to be placed upon the zeolite. After the exchange takes place, the sieves are removed from the aqueous solution washed, then dried to a desired water content. By such methods, the sodium cations and any non-sodium cations which might be occupying exchangeable sites as impurities in a sodium-X zeolite can be essentially completely replaced with lithium cations. Adsorbents preferred for this process have a particle size range of from about 20 to about 40 U.S. Mesh. The term "essentially complete" shall mean that the residual sodium content of the adsorbent after the ion exchange of the base material shall be less than about 0.1 wt. % $Na_2O$. The water content of the adsorbent as measured by loss on ignition (LOI) at 900° C. may be from about 0.5 to about 10 wt. %, but to prevent capacity loss, it is preferred that the water content is below about 4 wt. %.

Typically, adsorbents used in separative processes contain the crystalline material dispersed in an amorphous inorganic matrix or binder, having channels and cavities therein which enable liquid access to the crystalline material. Amorphous material such as silica, or silica-alumina mixtures or compounds, such as clays, are typical of such inorganic matrix materials. The binder aids in forming or agglomerating the crystalline particles of the zeolite which otherwise would comprise a fine powder. The adsorbent may thus be in the form of particles such as typical of such inorganic matrix materials. The binder aids in forming or agglomerating the crystalline particles of the zeolite which otherwise would comprise a fine powder. The adsorbent may thus in the form of particles such as extrudates, aggregates, tablets, macrospheres or granules having a desired particle size range, from about 16 to about 40 mesh (Standard U.S. Mesh) (1.9 mm to 250 $\mu$).

Feed mixtures which can be used in the separation process of the invention include complex mixtures containing durene derived from petroleum or coal tar in narrow boiling point fractions in the range between 150° C. and 225° C. In Table 1 following is an analysis of a typical coal tar distillate fraction with a boiling point range of 150°-210° C. which may be separated by the present invention. The particular sample contained about 32% (wt.) durene, 40% (wt.) isodurene, 0.6% (wt.) prehnitene. Several components were identified only as $C_{11}$ or higher aromatics and are listed as unknowns. The sample contained various alkyl substituted monocyclic aromatics, in addition to durene and isodurene.

TABLE 1

| Component | Wt. % |
|---|---|
| 1-Methyl-3-Ethylbenzene | 0.2 |
| Unknown #1 | 0.9 |
| 1,2-Diethylbenzene | 0.3 |
| 1-Methyl-2-Propylbenzene | 0.9 |
| 1,2,3-Trimethylbenzene | 0.4 |
| Unknown #2 | 0.4 |
| 1,4-Dimethyl-2-Ethylbenzene | 0.2 |
| Unknown #3 | 0.2 |
| 1,3-Dimethyl-4-Ethylbenzene | 2.0 |
| Unknown #4 | 0.1 |
| 1,2-Dimethyl-4-Ethylbenzene | 5.1 |
| Indane | 1.6 |
| Unknown #5 | 0.1 |
| 1,3,-Dimethyl-2-Ethylbenzene | 0.4 |
| Unknowns #6 | 2.9 |
| 1,2-Dimethyl-3-Ethylbenzene | 7.7 |
| Durene | 32.1 |
| Isodurene | 39.6 |
| Unknowns #7 | 3.1 |
| Prehnitene | 0.6 |
| Unknown #8 | 1.2 |
| | 100.0 |

The present process is suitable for feeds containing 10 wt. % or greater durene in the feed mixture, but economic benefit may also be derived from the process when the feed mixture contains minor amounts of durene.

In the preferred isothermal, isobaric, liquid-phase operation of the process of the invention, we have found that desorbent materials comprising aromatic hydrocarbons, selected to differ in boiling point by at least about 5° C. from the boiling range of the feedstock so that the desorbent may be recovered for reuse, will result in selectivity for the extracted product when used with the aforesaid adsorbent. Suitable aromatic hydrocarbons are 1,2,3-trimethylbenzene (TMB), mesitylene, toluene, p-xylene, benzene and m-xylene; 1,2,3-TMB is particularly preferred.

Although both liquid and vapor phase operations can be used in many adsorptive separation processes, liquid-phase operation is preferred for this process because of the lower temperature requirements and because of the higher yields of extract product than can be obtained with liquid-phase operation over those obtained with vapor-phase operation. Adsorption conditions will include a temperature range of from about 80° to about 200° C. and a pressure sufficient to maintain liquid phase, ranging from about atmospheric to about 500 psig. Desorption conditions will include the same range of temperatures and pressures as used for adsorption conditions.

At least a portion of the extract stream and preferably at least a portion of the raffinate stream, from the separation process, are passed to separation means, typically fractionators or evaporators, where at least a portion of the desorbent material is separated to produce an extract product and a raffinate product, respectively.

A dynamic testing apparatus is employed to test various adsorbents with a particular feed mixture and desorbent material to measure the absorbent characteristics of adsorptive capacity, selectivity and exchange rate. The apparatus consists of an adsorbent chamber of approximately 70 cc volume having inlet and outlet portions at opposite ends of the chamber. The chamber is contained within a temperature control means and, in addition, pressure control equipment is used to operate the chamber at a constant predetermined pressure. Quantitative and qualitative analytical equipment such a refractometers, polarimeters and chromatographs can be attached to the outlet line of the chamber and used to detect quantitatively or determine qualitatively one or more components in the effluent stream leaving the adsorbent chamber. A pulse test, performed using this apparatus and the following general procedure, is used to determine selectivities and other data for various adsorbent systems. The adsorbent is filled to equilibrium with a particular desorbent material by passing the desorbent material through the adsorbent chamber. At a convenient time, a pulse of the feed mixture is injected for a duration of several minutes. Desorbent flow is resumed, and durene extract and raffinate components are separately eluted as in a liquid-solid chromatographic operation. The effluent can be analyzed on stream or alternatively, effluent samples can be collected periodically and later analyzed separately by analytical equipment and traces of the envelopes of corresponding component peaks developed.

From information derived from the test, adsorbent performance can be rated in terms of void volume, retention volume for an extract or a raffinate component, selectivity for one component with respect to the other, and the rate of desorption of an extract component by the desorbent. The retention volume of an extract or a raffinate component may be characterized by the distance between the center of the peak envelope of an extract or a raffinate component and the peak envelope of the tracer component (assumed to be void volume) or some other known reference point. It is expressed in terms of the volume in cubic centimeters of desorbent pumped during the time interval represented by the distance between the peak envelopes. Selectivity, ($\beta$), for an extract component with respect to a raffinate component may be characterized by the ratio of the distance between the center of the extract component peak envelope and the tracer peak envelope (or other reference point) to the corresponding distance between the center of the raffinate component peak envelope and the tracer peak envelope. The rate of exchange of an extract component with the desorbent can generally be characterized by the width of the peak envelopes at half intensity. The narrower the peak width the faster the desorption rate. The desorption rate can also be characterized by the distance between the center of the tracer peak envelope and the disappearance of an extract component which has just been desorbed. This distance is again the volume (cc) of desorbent pumped during this time interval.

The following examples are presented to illustrate the process of this invention. The examples are not intended to unduly restrict the scope of the claims.

EXAMPLE

A pulse test as described above was performed to evaluate the process of the present invention for separating durene from a mixture of hydrocarbons in the boiling point range of 150° to 210° C., derived from coal tar distillation. The feed mixture having the composition set forth in Table 1 above was approximately 32% (wt.) durene. The adsorbent was lithium exchanged X zeolite; the desorbent was 1,2,3-trimethylbenzene (hemimellitene). The temperature of the column was maintained at 180° C. during the test. A 2 cc pulse of 40 wt. % of the above feed mixture, 40 wt. % n-hexane and 20 wt. % of $_n$-$C_{14}$ as tracer was injected into the column. The results are as shown in the following Table 2 under the headings Gross Retention Volume (GRV), Net Retention Volume (NRV), and Selectivity ($\beta$). Durene was well separated from all other components in the complex feed mixture. Because of the difficulty in analyzing for specific components in the complex feed mixture and since all remaining feed components were relatively non-adsorbed and eluted near the void volume as raffinate components, groups of unidentified raffinate components were combined and plotted as Unknown Group A, Unknown Group B, etc.

TABLE 2

| Component | GRV (ml.) | NRV (ml.) | $\beta$ |
|---|---|---|---|
| n-Hexane | 38.2 | 0.6 | $\infty$ |
| Durene | 52.3 | 14.7 | 1.00 (Ref.) |
| Isodurene | 42.2 | 4.6 | 3.20 |
| n-$C_{14}$ | 37.6 | 0.0 | — |
| Unknown Group A RT = 13.5, 13.8, 15 | 45.2 | 7.6 | 1.93 |
| Unknown Group B RT = 21.3, 22.8 | 44.3 | 6.7 | 2.19 |
| Unknown Group C RT = 17.3, 22.2, 23 | 47.6 | 10.0 | 1.47 |
| Unknown Group D RT = 15.2, 23.4 | 46.5 | 8.9 | 1.65 |

What is claimed:

1. A process for separating durene from a heavy gasoline fraction hydrocarbon mixture comprising durene, isodurene, prehnitene and other polyalkylated monocyclic aromatic hydrocarbons boiling in the range from 150° to 225° C., said process comprising contacting said mixture at adsorption conditions with an adsorbent consisting essentially of an X zeolite exchanged with lithium cations at exchangeable sites thereby selectively adsorbing said durene thereon, removing non-adsorbed isomers of durene and said other polyalkylated monocyclic aromatic hydrocarbons from contact with said adsorbent and desorbing said durene with a liquid aromatic desorbent having a boiling point at least 5° C. higher or lower than the boiling point range of said hydrocarbon mixture.

2. The process of claim 1 wherein said hydrocarbon mixture comprises durenes and polymethyl substituted benzenes derived from petroleum or coal tar.

3. The process of claim 1 wherein said adsorption and desorption conditions include a temperature within the range of from about 80° C. to about 220° C. and a pressure sufficient to maintain liquid phase.

4. The process of claim 1 wherein said desorbent is selected from the group consisting of 1,2,3-trimethylbenzene, 1,3,5-trimethylbenzene, toluene, p-xylene, m-xylene, chlorobenzene and benzene.

* * * * *